US011193358B2

(12) United States Patent
Preiss

(10) Patent No.: US 11,193,358 B2
(45) Date of Patent: Dec. 7, 2021

(54) FIRING HEAD ASSEMBLY, WELL COMPLETION DEVICE WITH A FIRING HEAD ASSEMBLY AND METHOD OF USE

(71) Applicant: DynaEnergetics GmbH & Co. KG, Troisdorf (DE)

(72) Inventor: Frank Haron Preiss, Bonn (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 504 days.

(21) Appl. No.: 16/225,299

(22) Filed: Dec. 19, 2018

(65) Prior Publication Data

US 2019/0234189 A1 Aug. 1, 2019

Related U.S. Application Data

(60) Provisional application No. 62/624,174, filed on Jan. 31, 2018.

(51) Int. Cl.
*E21B 43/11* (2006.01)
*E21B 43/1185* (2006.01)
(Continued)

(52) U.S. Cl.
CPC ..... *E21B 43/1185* (2013.01); *E21B 23/04* (2013.01); *E21B 43/11852* (2013.01); *E21B 34/10* (2013.01)

(58) Field of Classification Search
CPC .... E21B 34/10; E21B 23/04; E21B 43/11852; E21B 43/1185
See application file for complete search history.

(56) References Cited

U.S. PATENT DOCUMENTS 3,800,705 A 4/1974 Tamplen
4,576,233 A 3/1986 George
(Continued)

FOREIGN PATENT DOCUMENTS

EP 0092476 A2 10/1983
EP 0586223 A2 3/1994
(Continued)

OTHER PUBLICATIONS

Hunting Titan, Ball Drop Hydraulic Actuated Firing Head, Mar. 22, 2015, 2 pages, http://www.hunting-intl.com/titan/tcp-firing-heads-and-hardware/ball-drop-hydraulic-actuated-firing-head.
(Continued)

*Primary Examiner* — Christopher J Sebesta
(74) *Attorney, Agent, or Firm* — Moyles IP, LLC

(57) ABSTRACT

A firing head assembly for use with a perforating gun is described. The firing head assembly includes a tubular housing, first and second pistons, and a compressible member arranged within a lumen of the tubular housing and positioned between the first and second pistons. According to an aspect, the assembly includes a plurality of upper locking arms and lower locking arms that engage with locking members formed in the tubular housing. The firing head assembly further includes upper and lower shear washers arranged at the second opening of the tubular body, in a sandwich type configuration with respect to the second piston. Pressures within the firing head assembly may be adjusted to activate the firing head assembly to either trigger an explosive reaction or to not trigger the explosive reaction.

17 Claims, 8 Drawing Sheets

(51) Int. Cl.
*E21B 23/04* (2006.01)
*E21B 34/10* (2006.01)

(56) References Cited

U.S. PATENT DOCUMENTS 4,616,701 A 10/1986 Stout et al.
4,616,718 A 10/1986 Gambertoglio
4,817,718 A 4/1989 Nelson et al.
4,886,127 A 12/1989 Ricles et al.
5,103,912 A 4/1992 Flint
5,165,489 A 11/1992 Langston
5,301,755 A 4/1994 George et al.
5,400,856 A 3/1995 Schmidt
5,490,563 A 2/1996 Wesson et al.
5,811,894 A * 9/1998 Buyers ..... E21B 43/11852 307/118
5,887,654 A * 3/1999 Edwards ..... E21B 23/04 166/297
5,971,072 A 10/1999 Huber et al.
6,055,213 A 4/2000 Rubbo et al.
6,244,340 B1 * 6/2001 McGlothen ..... E21B 41/0035 166/255.3
6,364,017 B1 4/2002 Stout et al.
7,487,833 B2 * 2/2009 Grigar ..... E21B 43/1185 166/297
8,726,996 B2 5/2014 Busaidy et al.
9,145,748 B1 9/2015 Meier et al.
9,388,665 B2 7/2016 Caminari
9,540,913 B2 1/2017 Moore
2008/0110612 A1 * 5/2008 Prinz ..... F42C 15/32 166/55.2
2014/0137723 A1 * 5/2014 Umphries ..... E21B 43/11855 89/1.15
2015/0041135 A1 * 2/2015 Coffey ..... E21B 43/11852 166/297

FOREIGN PATENT DOCUMENTS

EP 0647765 A2 4/1995
GB 2290128 A 12/1995
WO 2014171914 A1 10/2014

OTHER PUBLICATIONS

Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.
Schlumberger, HDF Hydraulic Delay Firing Head, Jul. 3, 2013, 3 pgs., https://www.slb.com/~/media/Files/perforating/product_sheets/tubing_conveyed_perforating/firing_systems/hdf_ps.pdf.
Petrowiki, Perforating Equipment, Nov. 21, 2014, 8 pgs., https://petrowiki.org/Perforating_equipment.
International Search Report and Written Opinion of International App. No. PCT/EP2019/050793, which is in the same family as U.S. Appl. No. 16/225,299 dated Apr. 23, 2019, 13 pgs.
Innovation, Science and Economic Development Canada, Canadian Intellectual Property Office, Office Action of App. No. CA 3,024,982, dated Nov. 20, 2019, in which US App. Public. No. 2015/0041135 was cited, 4 pgs.
International Bureau, Preliminary Report on Patentability for International App. No. PCT/EP2019/050793, dated Aug. 4, 2020, 9 pgs.

* cited by examiner

FIRING HEAD ASSEMBLY, WELL COMPLETION DEVICE WITH A FIRING HEAD ASSEMBLY AND METHOD OF USE

CROSS-REFERENCE TO RELATED APPLICATIONS

This application claims the benefit of U.S. Provisional Patent Application No. 62/624,174 filed Jan. 31, 2018, which is incorporated herein by reference in its entirety.

FIELD OF THE DISCLOSURE

This disclosure generally relates to a firing head assembly. More specifically, a firing head assembly having a safety assembly, and configured for use in a well completion device is described.

BACKGROUND OF THE DISCLOSURE

In the extraction of hydrocarbons, such as fossil fuels (e.g., oil) and natural gas, from underground wellbores extending deeply below the surface, complex machinery and explosive devices are utilized. It is common practice to facilitate the flow of production fluid by perforating a fluid bearing subterranean formation using a perforating gun, which is lowered into the wellbore to the depth of the formation and then detonated to form perforations in the formation surrounding the perforating gun. A firing head assembly is coupled to the gun and initiated/activated to fire the gun. While the firing head assembly may be coupled to the perforating gun before the gun is lowered into the wellbore, it is often preferred for safety and other reasons, to allow initiation of the firing head only after the gun is positioned in the wellbore. An initiator is designed to fire the explosive train in the perforating gun after the initiator sees/receives an appropriate command from the surface.

It is very important that the firing head used to initiate explosives in a perforating gun be reliable and safe in operation. There have been numerous accidents resulting in severe injury or death where an explosive well tool, such as a perforating gun, fires prematurely at the surface of a wellbore while personnel are rigging the tool in preparation for running it into the wellbore.

There may be countless reasons for an operator or personnel to decide not to fire a perforating gun that has been run into the wellbore. Such reasons may include problems with running the perforating gun into the wellbore (i.e., running in hole), problems with other completion equipment or problems with the perforating gun assembly or its related components. In addition, one potential risk is that after the firing procedure is performed, there may be no positive indication that the perforating gun actually fired, which may mean that there are live explosives/shaped charges returning to the surface of the wellbore. This may endanger all personnel and equipment present at the surface when the perforating guns are retrieved to the surface.

In view of continually increasing safety requirements and the problems described hereinabove, there is a need for a firing head assembly that facilitates safe initiation of shaped charges in a perforating gun. There is also a need for a firing head assembly for use in a perforating gun that reduces the risk of property damage and bodily harm, including death, in a firing condition. Furthermore, there is a need for a firing head assembly having a safety feature, which will not allow the perforating gun to fire unless an operator selects the option to fire the perforating gun. Additionally, there is a need for a firing head assembly that allows an operator to abort a firing operation in a manner that prevents firing of the perforating gun.

BRIEF DESCRIPTION OF THE EXEMPLARY EMBODIMENTS

According to an aspect, the present embodiments may be associated with a firing head assembly. The firing head assembly includes a tubular housing, and first and second pistons. The tubular housing includes a lumen extending between first and second ends. The first piston is proximate the first end of the housing, while the second piston is proximate the second end. Both pistons partially extend into the lumen and are slidably moveable within it. The firing head assembly further includes a compressible member disposed within the lumen between the first and second pistons. A plurality of upper locking arms and a plurality of lower locking arms are configured to engage with locking members formed in the tubular housing. The firing head assembly further includes an upper shear washer and a lower shear washer arranged at the second opening of the tubular body and spaced apart from each other. The shear washers are disposed adjacent the second piston in a sandwich-type configuration, and help to secure the second piston in place.

According to an aspect, the present embodiments may also be associated with a well completion device including a perforating gun and a firing head assembly that is operably associated with the perforating gun. The firing head assembly may be configured substantially as described hereinabove, and includes a tubular housing that has a first end, a second end, and a lumen extending therebetween. A first piston is proximate to the first end, and a second piston is proximate the second end in a spaced apart configuration from the first piston. Both pistons are slidably moveable within at least a portion of the lumen, with a compressible member disposed between them. The compressible member has a first end portion that abuts the first piston, and a second end portion that abuts the second piston. The compressible member is adjustable between relaxed, compressed and partially compressed states. A plurality of upper locking arms and a plurality of lower locking arms are disposed within the lumen, each of which are configured to releasably engage with the locking members positioned in the lumen.

Further embodiments are associated with a method of using a firing head assembly in a firing condition and a non-firing condition. The method includes lowering a well completion device, configured substantially as described hereinabove, into a wellbore. The well completion device includes a perforating gun and a firing head assembly in communication with the perforating gun. The firing head assembly includes a housing having a lumen, a first piston and a second piston spaced apart from the first piston with a compressible member between them. A plurality of upper locking arms and a plurality of lower locking arms are disposed in the lumen, and are configured to releasably engage with locking members disposed in the lumen. The first piston and the tubular housing define an upper chamber having a first pressure, and the second piston and the tubular housing define a lower chamber having a second pressure. The well completion device is positioned at a desired location within the wellbore using a conveyance device. The method further includes increasing the first pressure of the upper chamber until the first piston moves downwardly towards the second piston and the upper locking arms are secured to the upper locking member. This partially compresses the compressible member. The method further includes adjusting the wellbore pressure, and respectively the second pressure of the lower chamber to initiate an event. According to an aspect, the event includes either triggering an explosive reaction in the firing condition or canceling an explosive reaction in the non-firing condition.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
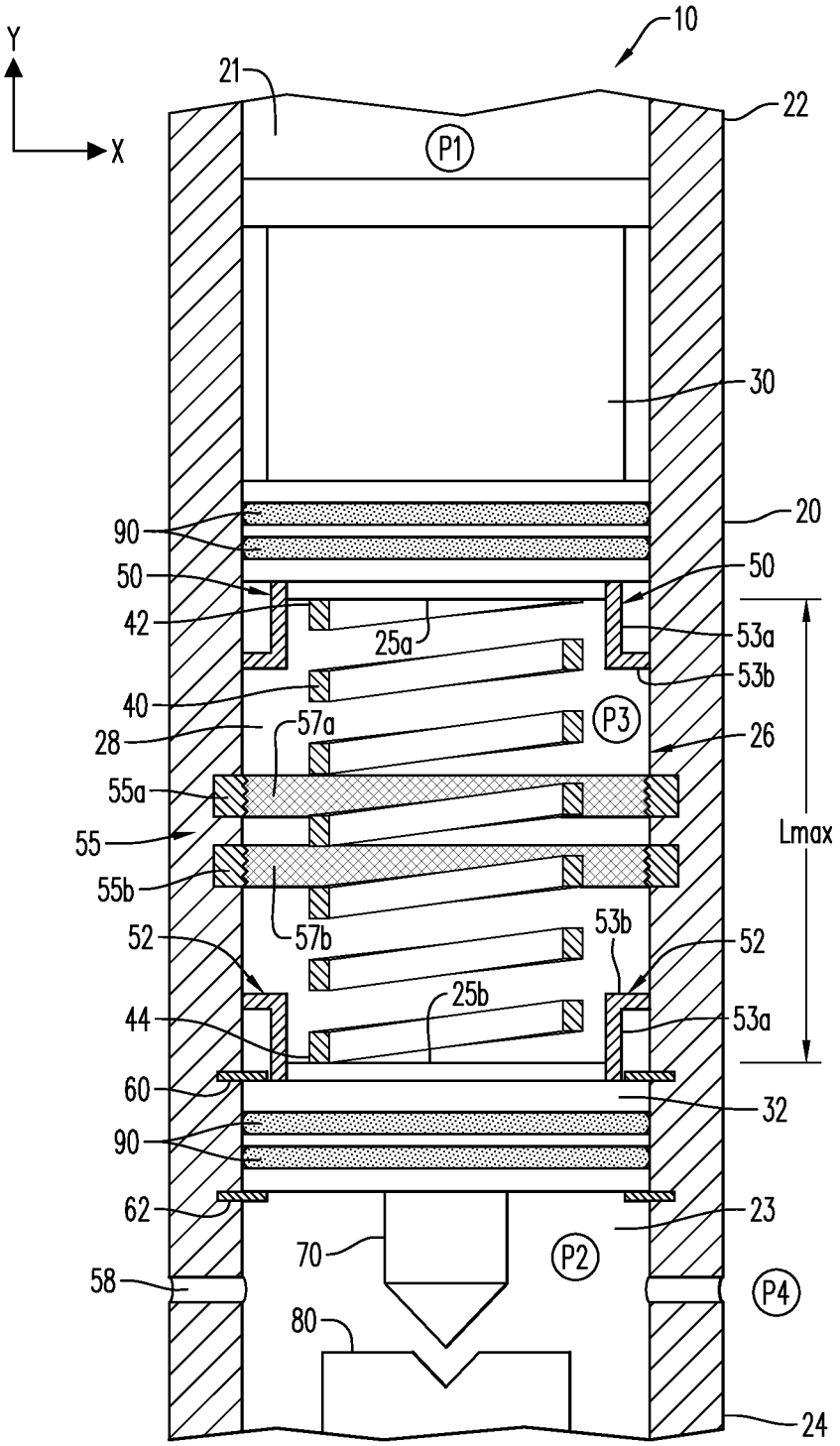
FIG. 1 is a partial cross-sectional, perspective view of a firing head assembly, illustrating a compressible member in a relaxed state, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation, and is not meant as a limitation and does not constitute a definition of all possible embodiments.

For purposes of illustrating features of the embodiments, reference will be made to various figures. FIGS. 1-4 generally illustrate embodiments of a firing head assembly. As will be discussed in connection with the individual illustrated embodiments, the firing head assembly generally includes a tubular housing/body, a first piston and a second piston, as well as a compressible member arranged between the first and second pistons. The firing head assembly also includes a plurality of upper locking arms and a plurality of lower locking arms that each engage with respective locking members positioned within the tubular housing, as well as upper and lower shear washers. The firing head assembly helps to facilitate safe rigging up and installation of a perforating gun string into a wellbore, safe initiation of shaped charges in a perforating gun, and safe retrieval of the perforating gun from the wellbore.

Turning now to the figures, FIGS. 1-4 illustrate a partial, cross-sectional view of a firing head assembly 10 (with at least some components being partially cutaway). The firing head assembly 10 includes a tubular housing or tubular body 20. The tubular housing 20 includes a first end 22 and a second end 24 spaced apart from one another. The tubular housing 20 has a lumen 26 that extends between the first and second ends 22, 24. According to an aspect, the lumen 26 has a diameter that is substantially uniform along a length of the housing 20. The diameter may be selected so that the lumen 26 is able to receive a plurality of components at least partially positioned therein.

The firing head assembly 10 includes a first piston 30 and a second piston 32. The first and second pistons 30, 32 are positioned, at least partially, within the lumen 26 of the housing 20. As illustrated in FIGS. 1-4, the first piston 30 is positioned proximate the first end 22 of the tubular housing 20 and is slidably moveable within at least a portion of the lumen 26. The second piston 32 is positioned proximate to the second end 24 of the tubular housing 20, opposite the first piston, and is similarly slidably moveable within at least a portion of the lumen 26. According to an aspect, movement of the first and second pistons 30, 32 may be facilitated at least in part by changes in a wellbore pressure or by the application of a force onto the pistons 30, 32, as will be discussed further below.

Figure 2:
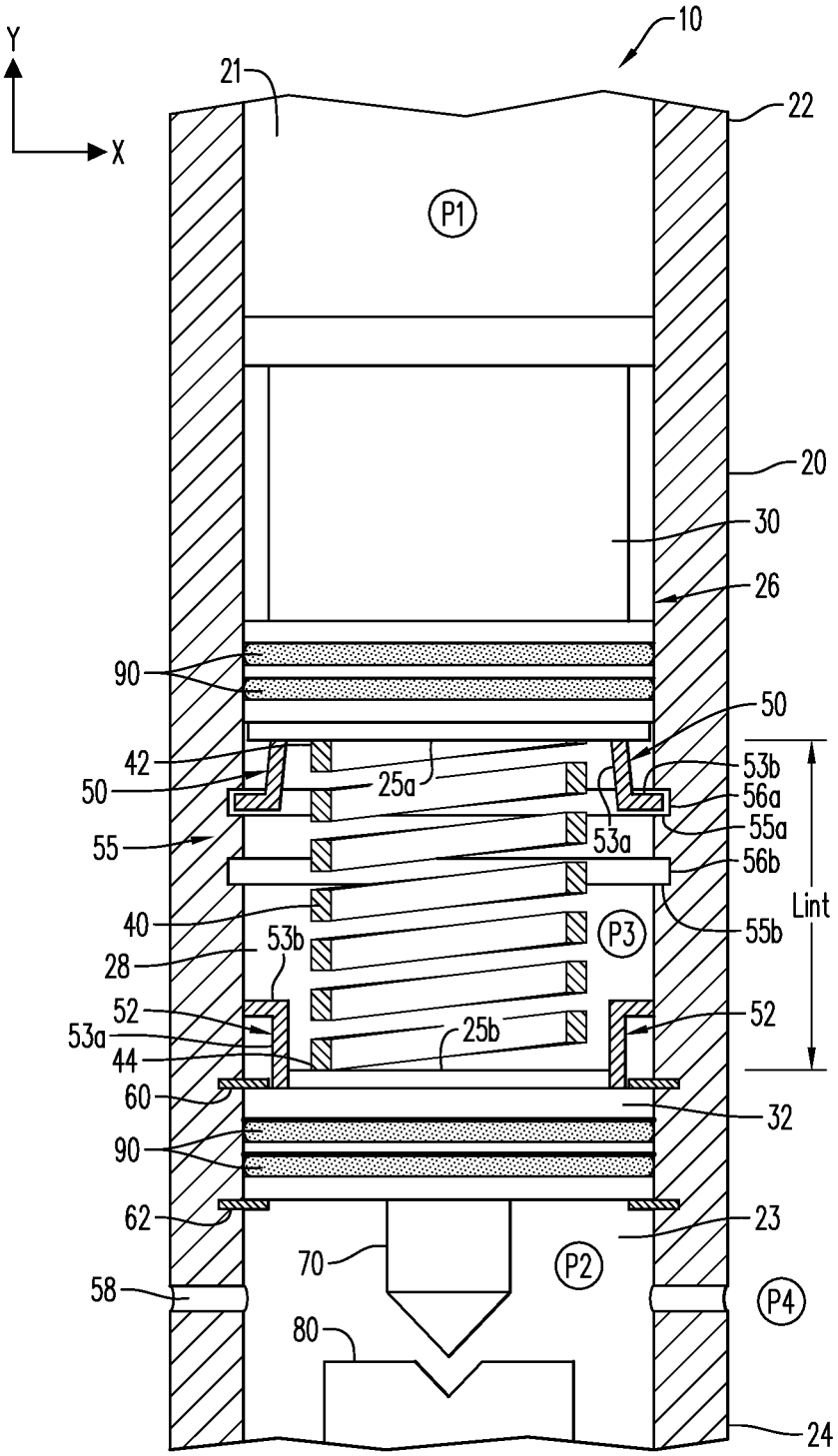
FIG. 2 is a partial cross-sectional, perspective view of a firing head assembly similar to that of FIG. 1 (except that the knurled locking rings are replaced by slots), illustrating the compressible member in a partially compressed state with a plurality of upper locking arms secured by locking members and a firing pin suspended above a percussion initiator.
Figure 3:
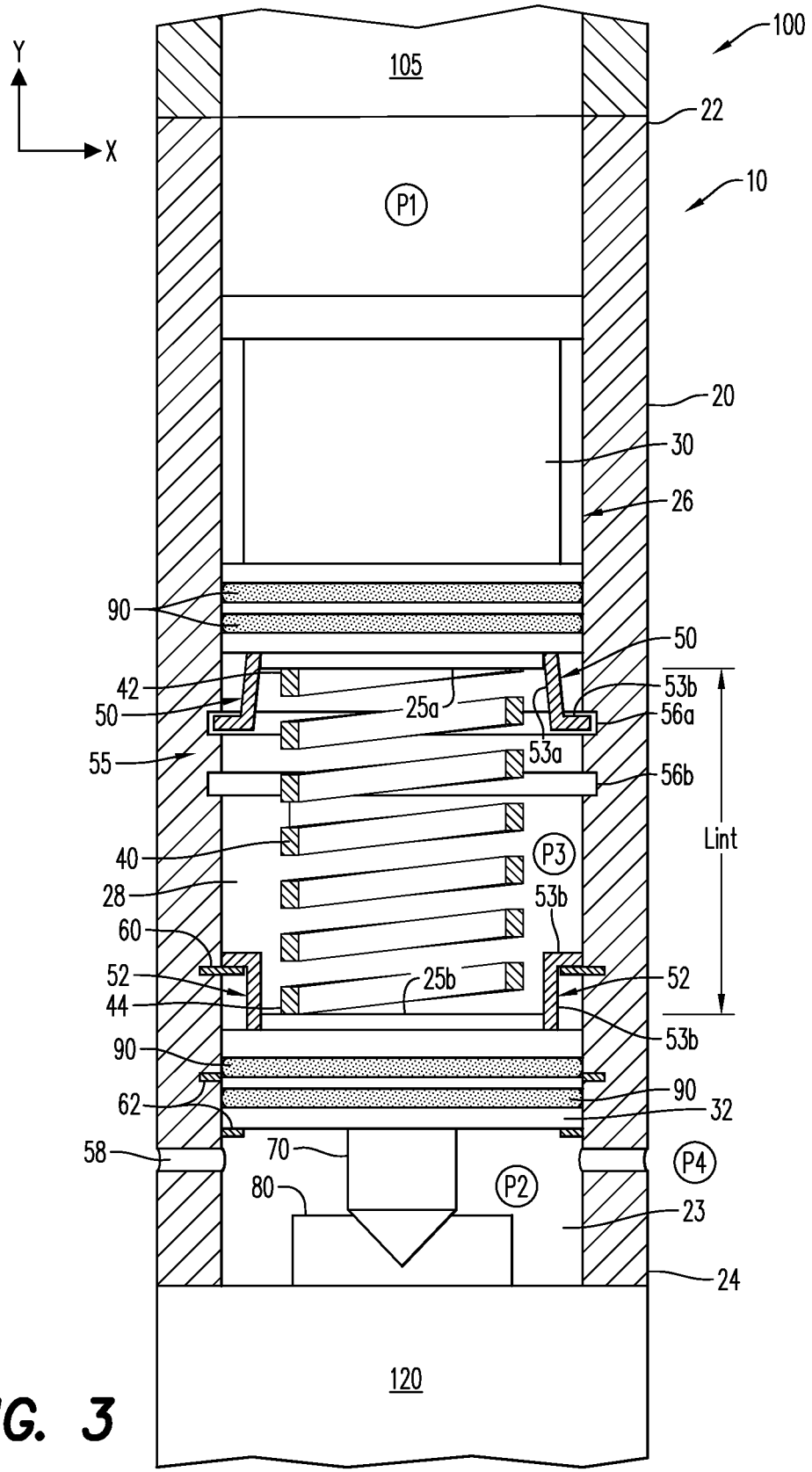
FIG. 3 is a partial cross-sectional, perspective view of the firing head assembly of FIG. 2, illustrating the compressible member in a partially compressed state with a plurality of upper locking arms secured by locking members and a firing pin in engagement with a percussion initiator.

In an embodiment, and as illustrated in FIGS. 1-3, the pistons 30, 32 are each coupled to mounting plates. The first piston 30 may be coupled or otherwise attached to a first mounting plate 25*a* (FIGS. 1-3), while the second piston 32 may be coupled or otherwise attached to a second mounting plate 25*b* (FIG. 1). As seen for instance in FIG. 1, the first and second mounting plates 25*a*, 25*b* may be smaller or have an outer diameter that is less that the outer diameter of the piston to which it is attached. Alternatively, and as seen for instance in FIG. 2, the outer diameter of at least one of the first mounting plate 25*a* and the second mounting plate 25*b* may be substantially the same as the outer diameter of the piston to which they are coupled to.

As seen best in FIG. 1, the first mounting plate 25*a* is positioned between the first piston 30 and the first end portion 42 of the compressible member 40, while the second mounting plate 25*b* is positioned between the second piston 32 and the second end portion 44 of the compressible member 40. Each mounting plate 25*a*, 25*b* includes upper and lower flattened (e.g., planar) surfaces. The upper flattened surface of the first mounting plate 25*a* is coupled to the first piston 30, while the lower flattened surface of the first mounting plate 25*a* abuts or engages a compressible member 40. The upper flattened surface of the second mounting plate 25*b* abuts or engages the compressible member 40, while the lower flattened surface of the second mounting plate 25*b* is coupled or attached to the second piston 32. According to an aspect, the first and second mounting plates 25*a*, 25*b* may receive a plurality of upper locking arms 50 and a plurality of lower locking arms 52, respectively, as is described in further detail hereinbelow. The mounting plates 25*a*, 25*b* interchangeably accommodate locking arms 50, 52 of various lengths, which aids in scope of the adjustment of the compressible member 40 within the lumen 26 of the tubular housing 20.

As described hereinabove, the firing head assembly includes a compressible member 40. The compressible member 40 is illustrated as a coil or spring that is arranged within the lumen 26 of the tubular housing 20. According to an aspect, the compressible member 40 includes a first end portion 42 and a second end portion 44. The first end portion 42 of the compressible member 40 abuts the first piston 30 or, when present, the lower flattened surface of the first mounting plate 25*a*. The second end portion 44 of the compressible member 40 abuts the second piston 32, or when present, the upper flattened surface of the second mounting plate 25*b*.

The compressible member 40 is adjustable between relaxed, partially compressed, and fully compressed states. As the first and second pistons 30, 32 move closer to each other, the length of the compressible member 40 is adjusted. According to an aspect, the compressible member 40 is adjustable between a maximum length Lmax (FIG. 1), a minimum length Lmin (FIG. 4), and a plurality of intermediate lengths Lint (FIGS. 2-3) therebetween. The maximum length Lmax corresponds to the relaxed state of the compressible member 40, the minimum length Lmin corresponds to the maximum compressed state of the compressible member 40, and the intermediate lengths Lint correspond to a plurality of partially compressed states of the compressible member 40.

While the compressible member 40 is illustrated in FIGS. 1-4 as a spring/coil, it is contemplated that the compressible member 40 may include or be a compressed gas (not shown). The compressed gas may be isolated within the lumen 26 of the housing 20, between the first and second pistons 30, 32. In this embodiment, when the first piston 30 moves closer to the second piston 32 or the second piston 32 moves closer to the first piston 30), particles of the compressed gas move closer together and are further compressed (i.e., the particles are positioned closer together). As the volume of the compressed gas decreases, the pressure within the lumen 26 between the first and second pistons 30, 32 also increase. Alternatively, when the first piston 30 moves away from the second piston 32, or alternatively the second piston 32 moves away from the first piston 30, particles of the compressed gas move away from each other and expand to fill the space in the lumen 26 between the first piston 30 and the second piston 32, which increases the volume of the compressed gas and decreases the pressure of the compressed gas.

The lumen 26 of the housing 20 may include one or more chambers. Each chamber may include pressures that are isolated from each other. According to an aspect, the first piston 30 and the tubular housing 20 at least partially define an upper chamber 21 of the lumen 26. The upper chamber 21 is above the first piston 30 (when the firing head assembly 10 is configured as shown in FIG. 1) and includes a first pressure P1. The second piston 32 and the tubular housing 20 at least partially define a lower chamber 23 of the lumen 26. The lower chamber 23 is below the second piston 32 (when the firing head assembly 10 is configured as shown in FIG. 1), and includes a second pressure P2. The area of the lumen 26, within which the compressible member 40 is disposed, is an intermediate chamber 28. The intermediate chamber 28 is between the upper chamber 21 and the lower chamber 23, and includes a third pressure P3. The volume of the intermediate chamber 28 directly corresponds to the movement of the first and second pistons 30, 32. As the first piston 30 moves towards the second piston 32, the volume of the intermediate chamber decreases, and as described hereinabove, compresses the compressible member 40 (spring or compressed gas). According to an aspect, when the compressible member 40 is a spring, the third pressure P3 may be atmospheric pressure.

The first and second pressures P1, P2 may be adjusted by various methods. According to an aspect, adding fluid to or removing fluid from the upper chamber 21 of the housing 20 adjusts the first pressure P1. Alternatively, a compressed gas may be used to increase the pressure inside the upper chamber 21. According to an aspect, the fluid or compressed gas may be added to or removed from the upper chamber 21 by virtue of being added to or removed from a conveyance device 105 (FIGS. 3-4) to which the firing head assembly 10 is attached. According to an aspect, an increase or decrease in the first pressure P1 adjusts the position of the first piston 30 in relation to the position of the second piston 32. An increase of the first pressure P1 moves the first piston 30 towards the second piston 32 and compresses the compressible member 40 to a partially compressed state. According to aspect, an operator of the firing head assembly 10 manually adjusts the position of the first piston 30 in the lumen 26. The operator can make the adjustment by increasing the first pressure P1, which will apply a force to the first piston 30 to move the piston 30 towards the second piston 32, which at least partially compresses or fully compresses the compressible member 40. Similarly, the operator can remove or at least partially reduce the first pressure P1 to partially reduce the force being applied to the first piston 30 to move the first piston 30 away from the second piston 32, which adjusts the compressible member 40 from a partially compressed state to a relaxed state.

At least one port/opening/vent 58 extends through the tubular housing 20, and fluidly connects the lower chamber 23 to the wellbore outside the tubular housing 20. This facilitates communication of fluids (i.e., liquids or gases) from the wellbore (i.e., wellbore fluid and the wellbore pressure P4) into the lower chamber 23. According to an aspect, the second pressure P2 can be adjusted by moving the firing head assembly 10 upwardly or downwardly in the wellbore, or by the addition to or removal of some wellbore fluid (or another fluid or compressed gas) from the wellbore. Since the port 58 facilitates the transfer of wellbore fluid, and therefore wellbore pressure P4, to the lower chamber 23 (and removal therefrom), an increase of the wellbore pressure P4 results in an increase in the second pressure P2. Similarly, a decrease of the wellbore pressure results in a decrease of the second pressure P2. As would be understood by one of ordinary skill in the art, the wellbore fluid may include at least one of nitrogen, drilling fluid, water, any completion fluid or any other industry standard.

The firing head assembly 10 includes a plurality of sealing members 90. According to an aspect, the sealing members 90 are O-rings that extend around a periphery of the first piston 30 and/or the second piston 32. At least one sealing member 90 is positioned around the periphery of the first piston 30, so that the sealing member 90 is between the first piston 30 and the lumen 26 of the tubular housing 20. At least one other sealing member 90 is positioned around the periphery of the second piston 32, between the second piston 32 and the lumen 26 of the tubular housing 20. The sealing members 90 may be operative for isolating the intermediate chamber 28 from the first pressure P1 of the upper chamber 21, the second pressure P2 of the lower chamber 23, and the wellbore pressure P4 outside the tubular housing 20. The sealing members 90 may be used to isolate each individual pressure, i.e., the first pressure P1 from the third pressure P3, and the third pressure P3 from the second pressure P2. The sealing members 90 also function to isolate the first and third pressures P1, P3 from the wellbore pressure P4.

The firing head assembly 10 is further equipped with a plurality of locking arms. As illustrated in FIGS. 1-4, a plurality of upper locking arms 50 extend from, are coupled to or otherwise connected to the first piston 30. Similarly, a plurality of lower locking arms 52 extend from, are coupled to or otherwise connected to the second piston 32. The locking arms 50, 52 may be formed of the same material used to form the mounting plates 25*a*, 25*b* and/or the upper and lower pistons 30, 32. The locking arms 50, 52 may be composed of any flexible and resilient material. According to an aspect, the locking arms 50, 52 are composed of a metal, such as, steel or copper. The locking arms 50, 52 may be composed of spring steel or beryllium copper.

Each locking arm 50, 52 includes a vertical segment 53*a*, and a horizontal segment 53*b* that extends radially from the vertical segment 53*a*. The vertical segment 53*a* of each upper locking arm 50 may be directly connected to the first piston 30 or, when present, directly connected to the first mounting plate 25*a*. The vertical segment 53*a* may extend a peripheral edge portion of the mounting plate 25*a*, 25*b* to which it is coupled, or may be connected to the lower flattened surface of the first mounting plate 25*a* or the upper flattened surface of the second mounting plate 25*b*. The vertical segment 53*a* extends along a Y-direction of the tubular housing 20, while the horizontal segment 53*b* extends radially from the vertical segment 53*a* generally along an X-direction of the tubular housing 20.

The horizontal segments 53*b* may be configured to frictionally engage with a portion of the tubular housing 20 to help retain the compressible member 40 at a desired position within the lumen 26. According to an aspect, the locking arms 50, 52 (i.e., the horizontal segments 53*b* of the locking arms 50, 52) engage with respective locking members 55 extending inwardly from the lumen 26 into the tubular housing 20. When engaged, the locking arms 50, 52 and the respective locking members 55 collectively prevent inadvertent movement of the compressible member 40.

The locking members 55 may include at least one of a knurled ring/knurled locking ring and a slot. As illustrated in FIG. 1 and in an embodiment, the locking members 55 include an upper knurled ring 57*a* and a lower knurled ring 57*b*. The knurled rings 57*a*, 57*b* may include a plurality of impressions in its surface, such as diamond, angled or straight patterns, which improves friction/provides an enhanced gripping surface. The upper locking arms 50 are resilient and configured for engaging the upper knurled ring 57*a*, and the lower locking arms 52 are resilient and configured for engaging the lower knurled ring 57*b*. The upper and lower knurled rings 57*a*, 57*b* help to facilitate engagement with the upper and lower locking arms 50, 52, respectively. This helps to at least temporarily maintain the compressible member 40 at one of the intermediate lengths Lint or the minimum length Lmin.

In another embodiment shown in FIG. 2, the locking members 55 may include an upper slot 56*a* and a lower slot 56*b*. As described hereinabove with respect to the upper and lower knurled rings 57*a*, 57*b*, the upper and lower locking arms 50, 52 are resilient and configured for engaging with their respective slots 56*a*, 56*b*. When each locking arm 50, 52 is engaged with its respective slot 56*a*, 56*b*, the compressible member 40 is for being at least temporarily maintained at one of the intermediate lengths Lint and the minimum length Lmin.

The firing head assembly 10 includes a firing pin 70 positioned below the second piston 32 in a spaced apart configuration, and a percussion initiator 80 positioned below the firing pin 70 also in a spaced apart configuration. The locking arms 50, 52 and the locking members 55, in conjunction with the first and second pistons 30, 32, and the compressible member 40, help facilitate selective activation of the firing head assembly 10, by adjusting the distance (such as, by reducing the distance) between the firing pin 70 and the initiator 80. According to an aspect, the distance is adjusted so that the firing pin 70 is brought into contact with the initiator 80, thereby triggering/activating an explosive reaction. The explosive reaction may start a sequence of events that causes shaped charges 122 loaded in a perforation gun 120 (see, for example, FIG. 6) to detonate.

To further aid in the selective activation of the firing head assembly 10, a plurality of securing devices may be utilized to help prevent and/or facilitate movement of the compressible member 40, which may either bring the firing pin 70 into contact with the initiator 80 to trigger the explosive reaction, or maintain the firing pin 70 in a spaced apart configuration from the initiator to prevent the explosive reaction. The securing devices may generally have a maximum strength (i.e., the largest force they can withstand before breaking and releasing the lower piston 32 and in return the compressible member 40). The securing devices may be selected based on wellbore conditions and their maximum strength, and may include, for example, shear washers, shear rings, shear pins, shear screws, and the like.

According to an embodiment, the firing head assembly 10 includes an upper shear washer 60 and a lower shear washer 62. Each shear washer 60, 62 is positioned adjacent the second opening 24 of the tubular body 20. The shear washers 60, 62 may include a central opening that allows them to be at least partially secured around the periphery of the second piston 32. As illustrated in FIGS. 1-2 and in an embodiment, the upper and lower shear washers 60, 62 are arranged at a spaced apart configuration with respect to each other, and are disposed adjacent the second piston 32 in a sandwich-type configuration. The upper shear washer 60 and lower shear washer 62 are configured to retain the second piston 32 at designated location in such a manner that the firing pin 70 is spaced apart from the percussion initiator 80. At least one of the shear upper shear washer 60 and the lower shear washer 62 may be configured to withstand a force of between about 500 psi to about 35,000 psi, alternatively between about 500 psi to about 25,000 psi, prior to breaking. According to an aspect, when the force being exerted on the lower shear washer 62 is greater than the largest force the shear washer 62 is designed to withstand, the shear washer 62 breaks, which moves the firing pin 70 towards the initiator 80. When the force being exerted on the upper shear washer 60 is greater than the largest force the upper shear washer 60 is designed to withstand, the upper shear washer 60 breaks, which may move the second piston and lower locking arms upwardly until the lower locking arms are secured in the locking members 55 (i.e., the lower knurled ring 57*b* (FIG. 1) or the lower slot 56*b* (FIGS. 2-4)). As will be described in further detail hereinbelow, these upward movements allow the firing pin 70 to move further away from the initiator 80, so that the firing assembly can be retrieved from the wellbore.

According to an aspect, an increase of the first pressure P1 moves the first piston 30 towards the second piston 32, which adjust the compressible member 40 to a partially compressed state. As illustrated in FIG. 2, this also moves the upper locking arms 50 downwardly towards the locking members 55 so that they can be secured thereby, which also retains the compressible member 40 in its partially compressed state. While FIG. 2 illustrates the upper locking arms 50 being secured in upper slots 56*a*, it is contemplated that the upper locking arms may be secured in place by upper knurled rings 57*a* (FIG. 1).

Adjustments of the wellbore pressure P4, and the respective second pressure P2 of the lower chamber 23 may be made to either trigger an explosive reaction or retrieve the firing head assembly 10 (i.e., including the perforating gun to which it is connected to) from the wellbore. A decrease of the wellbore pressure P4 outside the tubular housing 20 respectively decreases the second pressure P2 of the lower chamber 23, by way of the port 58, which facilitates communication of wellbore fluid into the lower chamber 23. Coupled with the partially compressed state of the compressible member 40, the decrease of the second pressure P2 breaks the lower shear washer 62, which allows the firing pin 70 to move downwardly to strike the initiator 80 and trigger the explosive reaction. Alternatively, when the compressible member 40 is partially compressed, an increase of the wellbore pressure P4 and respectively the second pressure P2 of the lower chamber 23 breaks the upper shear washer 60. This moves the second piston 32, and therefore the lower locking arms 52 upwards towards the lower slot 56*b* (or the lower knurled ring 57*b*), further compressing the compressible member 40 so that it is adjusted to its compressed state. When the lower locking arms 52 are within the lower slot 56*b* or in engagement with the lower knurled ring 57*b*, the firing pin 70 is moved further away from the initiator 80, which enables the firing head assembly 10 to be safely retrieved from the wellbore without triggering the explosive reaction.

Figure 4:
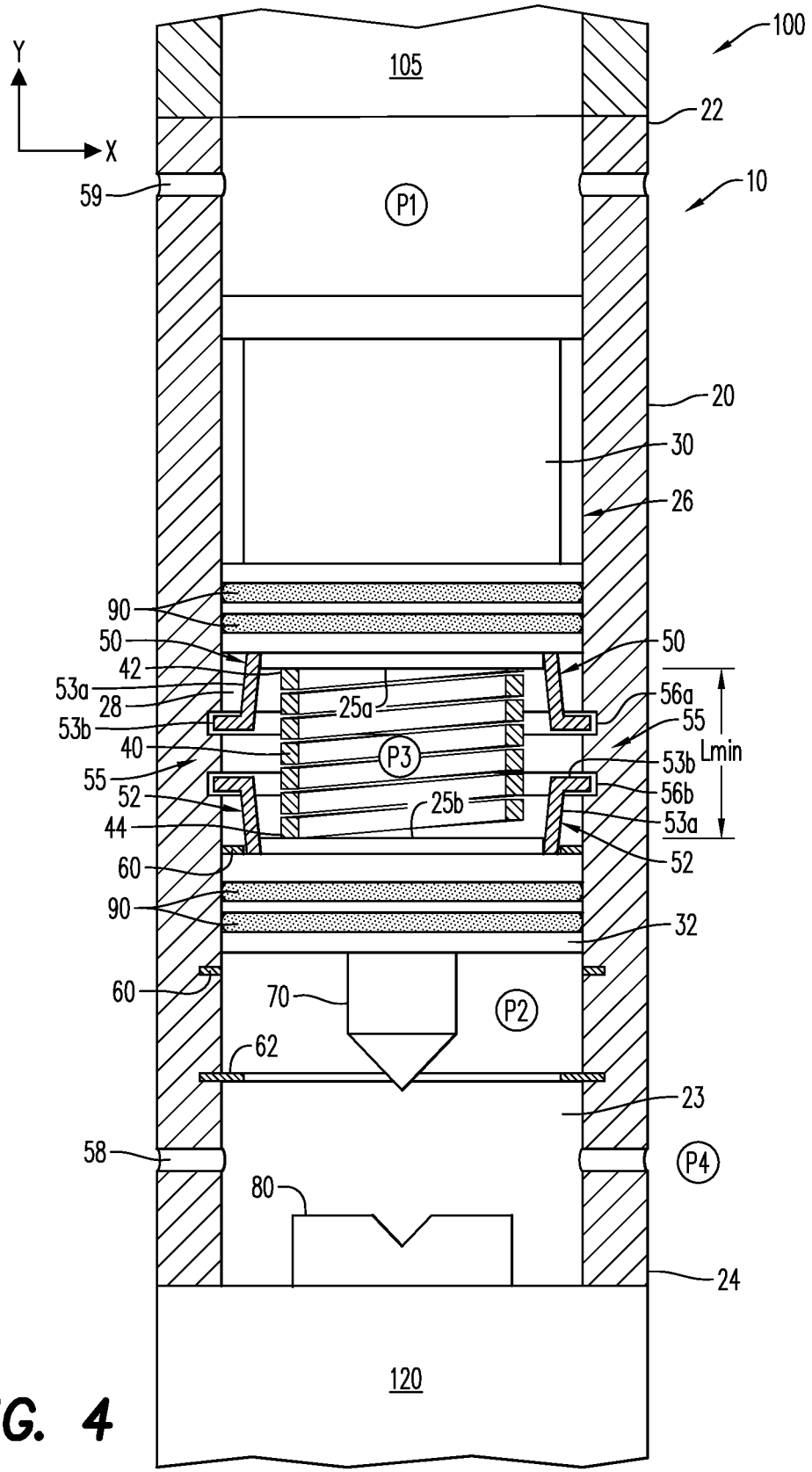
FIG. 4 is a partial cross-sectional, perspective view of the firing head assembly of FIG. 3, illustrating a compressible member in a compressed state, with a plurality of upper locking arms and a plurality of lower locking arms secured by locking members, according to an embodiment.
Figure 5:
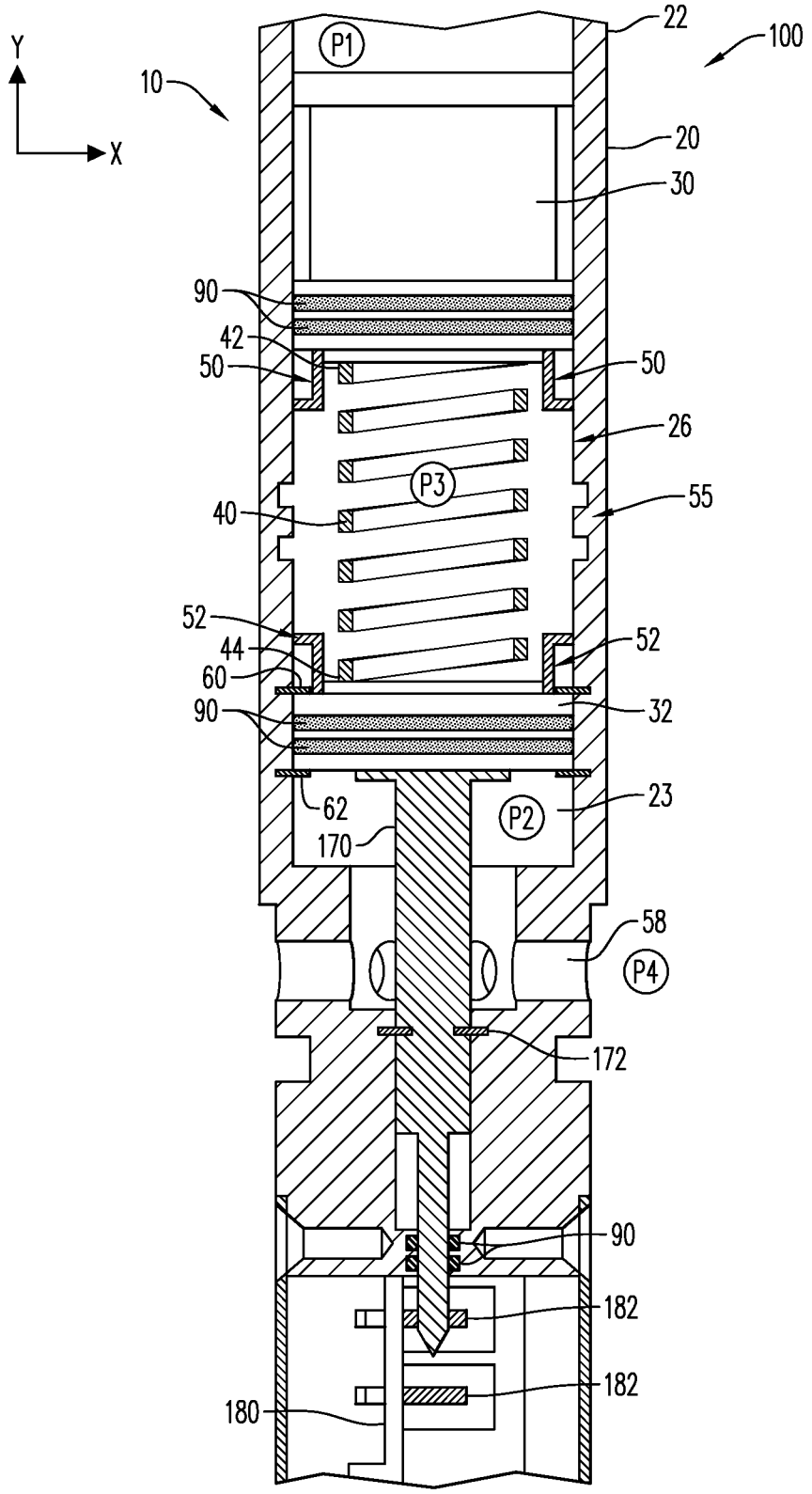
FIG. 5 is a partial cross-sectional, perspective view of a firing head assembly including an electric contact pin and an electric circuit board, according to an embodiment.

While the firing head assembly 10 has been described for use with a firing pin 70 and a percussion initiator 80 spaced apart from and positioned below the firing pin 70, it is contemplated that the firing head assembly 10 may be used with other components. In an embodiment and as illustrated in FIG. 5, the firing head assembly 10 includes an electric contact pin 170 and an electric circuit board 180 to facilitate activation of the firing head assembly 10, rather than the firing pin 70 and the percussion initiator 80 described hereinabove. The electric contact pin 170 and the electric circuit board 180 are arranged substantially similar to the arrangement of the firing pin 70 and the percussion initiator 80 illustrated in FIGS. 1-4, and described hereinabove. Thus, for purposes of convenience and not limitation, the various features, attributes, and arrangement of the electric contact pin 170 and the electric circuit board 180, where similar to the various features, attributes, and arrangement of the of the firing pin 70 and the percussion initiator 80 discussed in connection with FIGS. 1-4, are not repeated here.

As described hereinabove, sealing members 90 may isolate each individual pressure from each other, such as, the first pressure P1 from the third pressure P3, and the third pressure P3 from the second pressure P2. According to an aspect, sealing members 90 may also extend around a periphery of the electric contact pin 170, at an area below the port 58. The sealing members 90 may prevent the wellbore fluid or the second pressure P2 from interacting with or potentially impacting the circuit board 180 and/or its related components.

As illustrated in FIG. 5 and in an embodiment, the electric contact pin 170 is spaced apart from the electric circuit board 180, and is at least temporarily maintained in that position by securing elements 172. The securing elements 172 have a maximum strength (i.e., the largest force they can withstand before breaking). According to an aspect, the securing elements 172 include one of a shear pin and a shear screw. The securing elements 172 may be a shear ring configured as a relatively thin plate of material composed of a relatively soft, yet rigid material. The shear ring includes a central opening that allows the shear ring to be positioned around a periphery of the electric contact pin 170. According to an aspect, the shear ring includes a plurality of gaps/slits formed in its body, which allow the shear ring to break at a specified pressure differential or to withstand a selected force. The selected securing element 172, such as the described shear ring, may be selected based on wellbore conditions and its maximum strength. In an embodiment, the securing element 172 has a designated strength that allows it to break predictably at a specified value. For example, the securing element 172 may be configured to withstand a force from between about 500 psi to about 35,000 psi, for example, from between about 500 psi to about 25,000 psi, before breaking at its specified value.

According to an aspect, the electric contact pin 170 is released from its secured position when the force exerted on the lower shear washer 62 is greater than the largest force the shear washer 62 withstands (i.e., a force between about 500 psi to about 35,000 psi, alternatively between about 500 psi to about 25,000 psi). The force exerted on the lower shear washer 62 may break the lower shear washer 62, so that the second piston 32 moves downwardly and contacts the electric contact pin 170 to strike and break/shear the securing element 172. Once the securing element 172 is broken, the electric contact pin 170 is released from its position and moves downwardly towards the electric circuit board 180. The electric contact pin 710 applies a downward force (i.e., strikes or engages) to the circuit board 180 to trigger the explosive reaction or commence a time countdown sequence that triggers the explosive reaction.

According to an aspect, a plurality of electrical contacts 182 are disposed on a surface of the electric circuit board 180. The contacts 182 may each have an opening extending therethrough, where the opening is configured to receive a portion of the electric contact pin 170 so that the pin 170 engages with the contacts 182 and thus, the electric circuit board 180.

The electric circuit board 180 is communicable connected to a detonator (not shown), which directly triggers the explosive reaction. The detonator may be an RF-safe electronic detonator, a resistorized/electric detonator, or a detonator using a fire set, an EFI, an EBW, a semiconductor bridge and/or an igniter. According to an aspect, the resistorized/electric detonator is a 50 Ohm safe detonator. When the electric contact pin 170 engages the electric circuit board 180, the electric contact pin 170 engages with the electrical contacts 182 on the circuit board 180 to trigger the explosive reaction or begin the time countdown sequence to send the electric signal that triggers the explosive reaction to the detonator. The time countdown sequence indicates how much time remains until an electrical signal is sent to the detonator. According to an aspect, the electric signal may be a firing sequence that is sent to the detonator to trigger the explosive reaction.

According to an aspect, the lower piston 32 may be moved further away from the electrical contact pin 170, thereby preventing the electrical contact pin 170 from contacting the electric circuit board 180, which inhibits/cancels the firing sequence to trigger the explosive reaction. As described hereinabove in relation to the firing pin 70 and percussion initiator 80, the upper shear washer 60 breaks when the force exerted on the upper shear washer 60 is greater than the force the upper shear washer 60 is able to withstand. This causes the lower locking arms 50 to move upwardly until they are secured in the lower locking members 55. The lower piston 32 then moves upwardly, further away from the electrical contact pin 170, so that the explosive reaction is not triggered.

Figure 6:
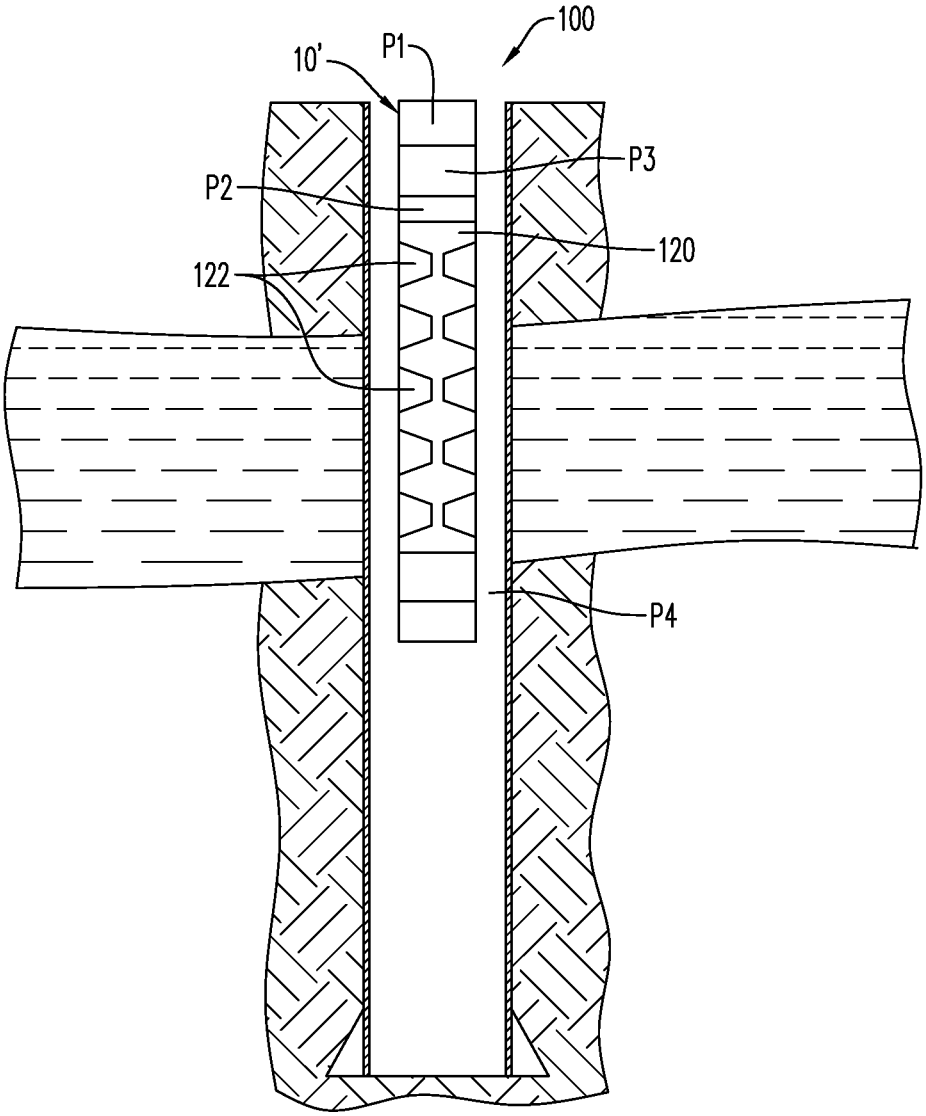
FIG. 6 is a cross-sectional view of a well completion apparatus including a firing head assembly, according to an embodiment.

Further embodiments may be associated with a well completion device 100. As illustrated in FIG. 6, the well completion apparatus 100 includes a perforating gun 120 having a plurality of shaped charges 122. The perforating gun 120 may be an exposed perforation gun system or a perforating assembly enclosed in a tubing or pipe. If the perforating gun 120 is an exposed system, the shaped charges 122 are individually encapsulated or sealed to prevent direct exposure to fluids and/or pressure from the wellbore environment. In any event, when the perforating gun 120 is fired and the shaped charges 122 detonate, an explosive jet is formed, which perforates the surrounding formation in the wellbore to extract fluid (such as oil, gas, and the like) therefrom.

The well completion device 100 includes a firing head assembly 10' operable associated with the perforating gun 120. The firing head assembly 10' is substantially similar to the firing head assembly 10 illustrated in FIGS. 1-4, and described hereinabove. Thus, for purposes of convenience and not limitation, the various features, attributes, properties and functionality of the firing head assembly 10 discussed in connection with FIGS. 1-4 are not repeated here.

As described hereinabove, the firing head assembly 10' includes a plurality of upper locking arms 50 and a plurality of lower locking arms 52 for releasably engaging with the locking members 55 (i.e., upper locking member 55*a* or lower locking members 55*b*, respectively, as illustrated in FIGS. 1-2). When the upper locking arms 50 are secured in the upper locking member 55*a*, the compressible member 40 is in a partially compressed state. This is facilitated by an increase of the first pressure P1 of the upper chamber 21, which moves the first piston 30 downwardly towards the second piston 32. In this configuration, the firing head assembly 10' may be deactivated to facilitate safe retrieval of the perforating gun 120 from the wellbore without triggering an explosive reaction or activated to trigger the explosive reaction.

In order to safely retrieve the well completion device 100 from the wellbore without triggering the explosive reaction, the second pressure P2 (located in the lower chamber 23 of the firing head assembly 10') must be increased until it creates a force that exceeds the maximum strength of the upper shear washer 60. This is done by increasing the wellbore pressure P4 by moving the well completion device 100 (including the firing head assembly 10') downwardly in the wellbore or by adding a fluid or a compressed gas to the wellbore. Coupled with the partially compressed state of the compressible member 40, when the force created by the increased second pressure P2 overcomes the maximum strength of the upper shear washer 60 and the force generated by the partially compressed member, the upper shear washer 60 breaks. This facilitates movement of the second piston and the lower locking arms 52 upwardly, until they are secured by the lower locking members 55*b*. As seen for instance in FIG. 4, the firing pin 70 is also moved further away from the initiator 80. In this configuration, the well completion device 100 may be safely retrieved from the wellbore without triggering the explosive reaction.

Alternatively, in order to trigger the explosive reaction while the perforating gun 120 is in the wellbore, the second pressure P2 must be decreased until a compressive force generated by the compressible member 40 exceeds the maximum strength of the lower shear washer 62. When the compressive force of the compressible member 40 exceeds the maximum strength of the lower shear washer 62, the lower shear washer 62 breaks, which releases the second piston 32 from its secured position. The compressive force of the compressible member 40 drives the firing pin 70 downwardly towards the initiator 80. The firing pin 70 strikes the initiator 80 and triggers the explosive reaction. The explosive reaction includes detonation of the shaped charges 122 of the perforating gun 120, which creates perforations in the underground formation.

Embodiments of the present disclosure further relate to a method 200 of using a firing head assembly in a firing condition and a non-firing condition. The firing head assembly is in communication with a perforating gun. According to an aspect, a well completion device includes the firing head assembly and the perforating gun. The perforating gun and firing head assembly are substantially similar to the perforating gun and firing head assembly illustrated in FIGS. 1-6, and described hereinabove. Thus, for purposes of convenience and not limitation, the various features, attributes, properties, and functionality of the perforating gun and firing head assembly discussed in connection with FIGS. 1-6 are not repeated here.

Figure 7:
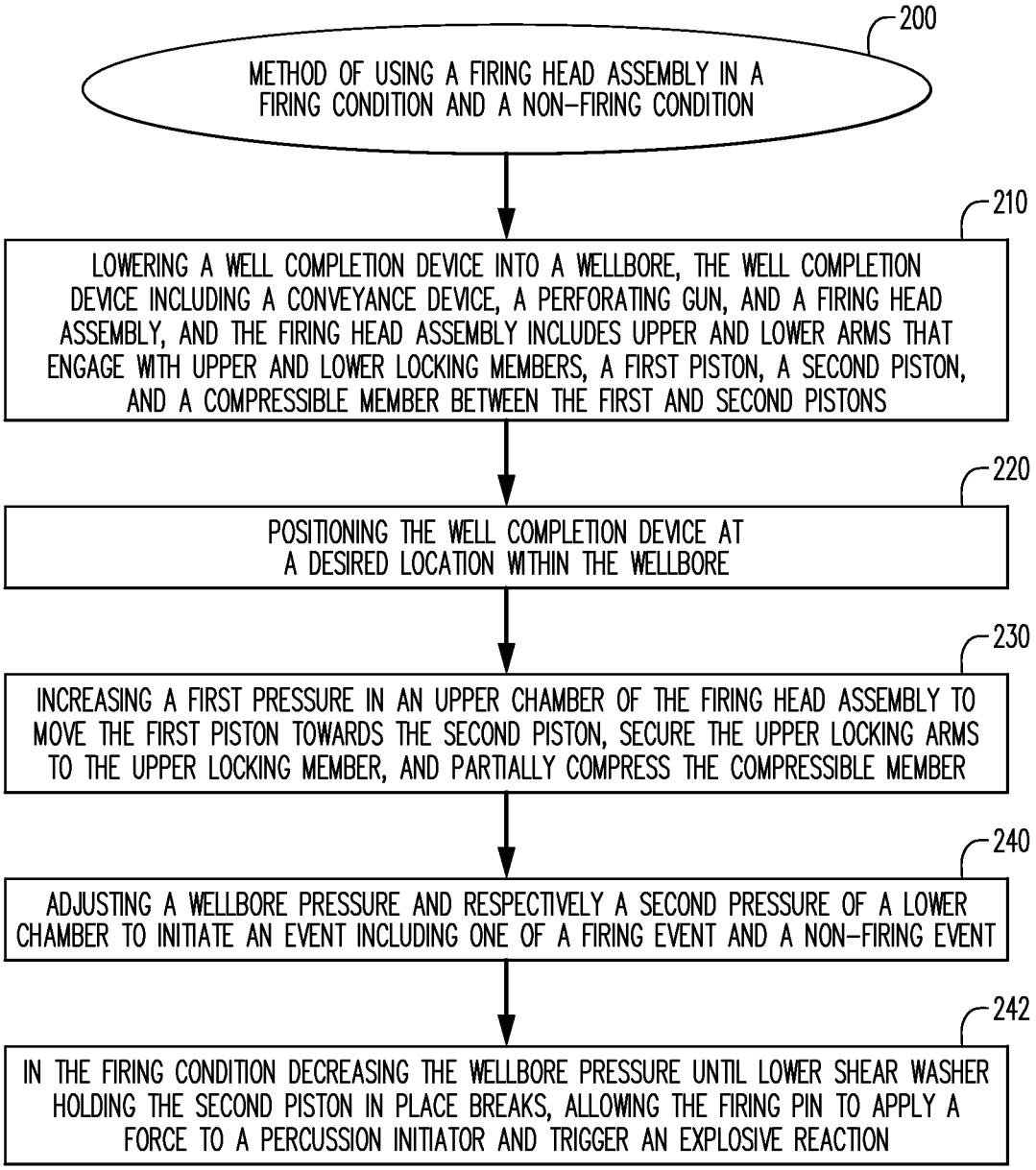
FIG. 7 is a flow chart illustrating a method of using a firing head assembly in a firing condition and a non-firing condition, according to an embodiment.
Figure 8:
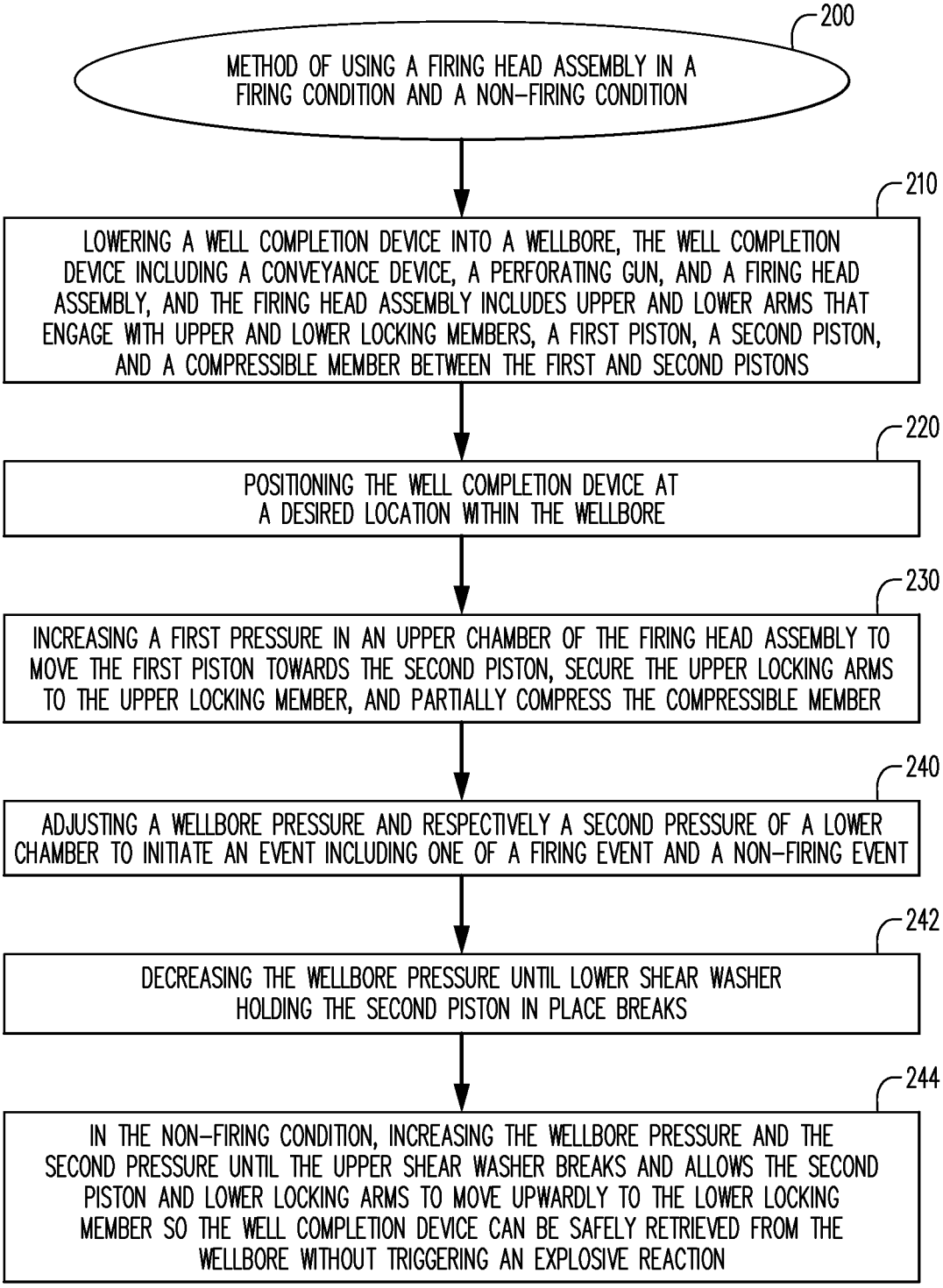
FIG. 8 is a flow chart illustrating a method of using a firing head assembly in a firing condition and a non-firing condition, according to an embodiment.

As illustrated in FIGS. 7 and 8, the method 200 includes lowering 210 the well completion device, including the perforation gun and firing head assembly, into a wellbore using a conveyance device. The well completion device is positioned 220 at a desired location within the wellbore. The first pressure of the upper chamber is increased 230 (or a force is applied thereto) until the first piston moves downwardly towards the second piston to secure the upper locking arms within or by the upper locking member. In this configuration, the compressible member is partially compressed. With the compressible member in its partially compressed state, the wellbore pressure and therefore the second pressure of the lower chamber may be adjusted 240 to initiate an event.

The wellbore pressure may be adjusted by moving the well completion device downwardly or upwardly in the wellbore. When the well completion device is moved downwardly in the wellbore, the second pressure increases, which may further compress the compressible member to move the firing pin away from the initiator. Alternatively, moving the well completion device upwardly in the wellbore decreases the second pressure, which may result in the compressive force generated by the compressible member being strong enough to break the lower shear washer.

According to an aspect, adding a fluid (i.e., liquid or gas) to or removing at least some from the wellbore is also operative for adjusting the wellbore pressure. Such fluids may include at least one of nitrogen, drilling fluid, water and any completion fluid. Adding such fluids may increase the second pressure, and break the upper shear washer, so that the compressible member may be adjusted to a compressed state. Alternatively, removing such fluids may decrease the second pressure, and break the lower shear washer so that the compressible member is released from its secured position and expands. As described hereinabove, the expansion of the compressible member or its adjustment from a compressed/partially compressed state to a relaxed state forces the firing pin towards the initiator to trigger the explosive reaction.

According to an aspect, the event initiated by the adjusting step 240 includes triggering an explosive reaction in the firing condition, and canceling an explosive reaction in the non-firing condition.

FIG. 7 illustrates the method 200 of using the firing head assembly in the firing condition, while FIG. 8 illustrates the method 200 of using the firing head assembly in the non-firing condition. In the firing condition, the wellbore pressure is decreased 242 until the lower shear washer holding the second piston in position breaks. Once the lower shear washer has been broken, the compressible member is no longer secured by the lower piston, and expands in a manner that forces the firing pin into the percussion initiator to trigger the explosive reaction (FIG. 3). In the non-firing condition, the wellbore pressure is increased 244 until the upper shear washer holding the second piston in position breaks. Once the upper shear washer has been broken, the compressible member is forced towards the first piston by the second pressure until the lower locking arms are secured in the lower locking members. This also moves the firing pin further away from the percussion initiator, and maintains the compressible member in a secured position so that the well completion device can be retrieved from the wellbore without triggering the explosive reaction (FIG. 4).

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A firing head assembly, comprising:

a tubular housing having a first end, a second end, and a lumen extending between the first end and the second end;

a first piston and a second piston positioned at least partially within the lumen, wherein the first piston is positioned proximate to the first end of the tubular housing and is slidably moveable within at least a portion of the lumen, and the second piston is positioned proximate to the second end of the tubular housing and is slidably moveable within at least a portion of the lumen;

a compressible member arranged within the lumen of the tubular housing, the compressible member comprising a first end portion and a second end portion, the first end portion abutting the first piston and the second end portion abutting the second piston;

a plurality of upper locking arms and a plurality of lower locking arms, wherein each locking arm is configured to engage with respective locking members positioned within the tubular housing;

an upper shear washer and a lower shear washer, wherein the upper and lower shear washers are arranged adjacent to the second end of the tubular body in a spaced apart configuration with respect to each other; and at least one of:

a firing pin positioned below the second piston, and a percussion initiator positioned below the firing pin; and an electric contact pin positioned below the second piston, and an electric circuit board positioned below the electric contact pin, wherein the first piston and the tubular housing at least partially define an upper chamber of the lumen above the first piston, the upper chamber having a first pressure, the second piston and the tubular housing at least partially define a lower chamber of the lumen below the second piston, the lower chamber having a second pressure, and the compressible member is in an intermediate chamber of the lumen disposed between the upper chamber and the lower chamber.

2. The firing head assembly of claim 1, wherein:

the upper locking arms are coupled to the first piston; and the lower locking arms are coupled to the second piston.

3. The firing head assembly of claim 1, further comprising one of:

at least one port that fluidly connects the lower chamber to the wellbore pressure outside the tubular housing, so that the second pressure is the same as the wellbore pressure; and at least one port that fluidly connects the upper chamber to the wellbore pressure outside the tubular housing, so that the first pressure is the same as the wellbore pressure.

4. The firing head assembly of claim 1, wherein:

an increase of the first pressure moves the first piston and the upper locking arms downwardly towards the upper slot and compresses the compressible member to a partially compressed state; and a decrease of the wellbore pressure outside the tubular housing and respectively the second pressure of the lower chamber coupled with the partially compressed state of the compressible member, is operative for breaking the lower shear washer, thus allowing the firing pin to move downwardly to strike the initiator and trigger an explosive reaction, or the electric contact pin to move downwardly to strike the electric circuit board to trigger the explosive reaction.

5. The firing head assembly of claim 1, wherein:

an increase of the first pressure moves the first piston and the upper locking arms downwardly towards the upper slot and compresses the compressible member to a partially compressed state; and an increase of the wellbore pressure and respectively the second pressure of the lower chamber is operative for breaking the upper shear washer, moving the second piston and the lower locking arms upwards towards the lower slot, and compressing the compressible member until the lower locking arms engage in the lower slot so that the firing head assembly can be retrieved from the wellbore without triggering an explosive reaction.

6. The firing head assembly of claim 1, wherein the second pressure is adjusted by at least one of:

moving the firing head assembly upwardly or downwardly in the wellbore; and adding a fluid to or removing at least some fluid from the wellbore, where the fluid comprises at least one of nitrogen, drilling fluid, water and completion fluid.

7. A well completion device comprising:

a perforating gun; and a firing head assembly, comprising:

a tubular housing having a first end, a second end, an inner wall, a lumen bound by the inner wall and extending between the first end and the second end, and a plurality of locking members positioned in the lumen;

a first piston and a second piston, wherein the first piston is adjacent the first end of the tubular housing and the second piston is adjacent the second end of the tubular housing, and each of the first piston and the second piston slidably extends into the lumen;

a compressible member arranged within the lumen of the tubular housing, the compressible member having a first end portion abutting the first piston, and a second end portion abutting the second piston; and a plurality of upper locking arms and a plurality of lower locking arms, wherein each of the locking arms is configured to engage with one of the locking members, wherein the first piston and the tubular housing at least partially define an upper chamber of the lumen above the first piston, the upper chamber having a first pressure, the second piston and the tubular housing at least partially define a lower chamber of the lumen below the second piston, the lower chamber having a second pressure, the compressible member is in an intermediate chamber of the lumen disposed between the upper chamber and the lower chamber, the intermediate chamber having a third pressure comprising atmospheric pressure, and the firing head assembly comprises at least one sealing member positioned between the first piston and the lumen of the tubular housing, and at least one other sealing member positioned between the second piston and the lumen of the tubular housing, wherein the sealing members isolate the third pressure from the first pressure, the second pressure and a wellbore pressure outside the tubular housing.

8. The well completion device of claim 7, further comprising:

at least one port that fluidly connects the lower chamber to the wellbore pressure outside the tubular housing, so that the second pressure is the same as the wellbore pressure.

9. The well completion device of claim 7, further comprising one of:

a firing pin positioned below the second piston, and a percussion initiator positioned below the firing pin in a spaced apart configuration, wherein the firing pin is for applying a downward force to the initiator to trigger an explosive reaction; and an electric contact pin positioned below the second piston, and an electric circuit board positioned below the electric contact pin in a spaced apart configuration, wherein the electric contact pin is for contacting the electric circuit board to trigger the explosive reaction.

10. The well completion device of claim 9, wherein:

an increase of the first pressure of the upper chamber is operative for moving the first piston downwardly towards the second piston and moving the upper locking arms downwardly to the upper locking member, so that the upper locking arms are secured to the upper locking member and the compressible member is in a partially compressed state; and a decrease of the wellbore pressure outside the tubular housing and respectively the second pressure of the lower chamber is operative for breaking the lower shear washer, wherein breaking the lower shear washer allows the firing pin to move downwardly to strike the initiator and trigger the explosive reaction or allows the electric contact pin to move downwardly to contact the electric circuit board and trigger the explosive reaction.

11. The well completion device of claim 9, wherein:

an increase of the first pressure is operative for moving the first piston and the upper locking arms downwardly towards the upper slot and compressing the compressible member to a partially compressed state; and an increase of the wellbore pressure and respectively the second pressure of the lower chamber coupled with the partially compressed state of the compressible member, breaks the upper shear washer, and is operative for moving the second piston and the lower locking arms upwardly towards the lower slot, and compressing the compressible member until the lower locking arms engage in the lower slot, so that the well completion device can be safely retrieved from the wellbore without triggering the explosive reaction.

12. The well completion device of claim 7, further comprising:

a conveyance device comprising one of a production tubing, a drill pipe and a coiled tubing.

13. The well completion device of claim 7, wherein the first pressure and the second pressure are adjusted by at least one of:

moving the well completion device downwardly or upwardly in the wellbore; and adding a fluid to or removing the fluid from the wellbore.

14. A method of using a firing head assembly in a firing condition and a non-firing condition, the method comprising:

lowering a well completion device into a wellbore;

positioning the well completion device at a desired location within the wellbore, wherein the well completion device includes a conveyance device, a perforating gun and a firing head assembly in communication with the perforating gun, the firing head assembly comprising a tubular housing having a first end, a second end, and a lumen extending between the first end and the second end, wherein an upper locking member and a lower locking member is positioned in the lumen in a spaced apart configuration with respect to each other, a first piston and a second piston, wherein the first piston is adjacent the first end and the second piston is adjacent the second end, each of the first piston and the second piston at least partially extending into the lumen, the first piston and the tubular housing at least partially defining an upper chamber having a first pressure, and the second piston and the tubular housing at least partially defining a lower chamber having a second pressure, a compressible member arranged within the lumen of the tubular housing, the compressible member having a first end portion adjacent the first piston and a second end portion adjacent the second piston, wherein the compressible member is isolated from the first pressure, the second pressure, and a wellbore pressure outside the tubular housing, a plurality of upper locking arms and a plurality of lower locking arms, wherein the upper locking arms are releasably engageable with the upper locking member and the lower locking arms are releasably engageable with the lower locking member, an upper shear washer and a lower shear washer, wherein each shear washer is arranged adjacent the second opening of the tubular body on each side of the second piston and restricts movement of the second piston, and one of a firing pin arranged below the second piston and a percussion initiator arranged below the firing pin in a spaced apart configuration, and an electric contact pin positioned below the second piston and an electric circuit board positioned below the electric contact pin in a spaced apart configuration;

increasing the first pressure of the upper chamber until the first piston moves downwardly towards the second piston and the upper locking arms are secured to the upper locking member, thereby partially compressing the compressible member; and adjusting the wellbore pressure and respectively the second pressure of the lower chamber to initiate an event, the event including one of triggering an explosive reaction in the firing condition and canceling an explosive reaction in the non-firing condition.

15. The method of claim 14, wherein in the firing condition, the adjusting comprises:

decreasing the wellbore pressure and respectively the second pressure of the lower chamber until the lower shear washer breaks, so that the compressible member expands and forces the firing pin into the percussion initiator to trigger the explosive reaction or forces the electric contact pin into contact with the electric circuit board to trigger the explosive reaction.

16. The method of claim 15, wherein if the explosive reaction is not triggered by the step of decreasing the wellbore pressure, in the non-firing condition, the adjusting comprises:

increasing the wellbore pressure and respectively the second pressure of the lower chamber until lower piston is moved upward against the force of the compressible member and until the shear force of the upper shear washer is exceeded, thus breaking the upper shear washer and forcing the second piston and the lower locking arms to move further upwardly until the lower locking arms engage the lower locking member, so that the perforating gun and the firing head assembly may be removed from the desired location.

17. The method of claim 14, wherein in the non-firing condition, the adjusting comprises:

increasing the wellbore pressure and respectively the second pressure of the lower chamber, thus breaking the upper shear washer and forcing the second piston and the lower locking arms to move upwardly until the lower locking arms engage the lower locking member, so that the perforating gun and the firing head assembly may be removed from the desired location.

* * * * *